US008118572B2

(12) United States Patent
Klein

(10) Patent No.: US 8,118,572 B2
(45) Date of Patent: Feb. 21, 2012

(54) PERISTALTIC PUMP TUBING WITH STOPPER AND COOPERATIVE ROLLER ASSEMBLY HOUSING HAVING NO MOVING PARTS

(76) Inventor: Jeffrey A. Klein, San Juan Capistrano, CA (US)

( * ) Notice: Subject to any disclaimer, the term of this patent is extended or adjusted under 35 U.S.C. 154(b) by 315 days.

(21) Appl. No.: 12/539,984

(22) Filed: Aug. 12, 2009

(65) Prior Publication Data

US 2010/0202907 A1 Aug. 12, 2010

Related U.S. Application Data

(60) Provisional application No. 61/150,997, filed on Feb. 9, 2009.

(51) Int. Cl.
*F04B 43/12* (2006.01)

(52) U.S. Cl. ..... 417/477.12; 417/477.9

(58) Field of Classification Search ..... 417/477.12, 417/477.9

See application file for complete search history.

(56) References Cited

U.S. PATENT DOCUMENTS

| | | | | |
|---|---|---|---|---|
| 3,042,045 | A * | 7/1962 | Sheridan | 604/533 |
| 4,347,874 | A * | 9/1982 | Sullivan et al. | 141/1 |
| 4,515,536 | A | 5/1985 | van Os | |
| 4,767,289 | A | 8/1988 | Parrott et al. | |
| 4,813,855 | A | 3/1989 | Leveen et al. | |
| 4,954,055 | A | 9/1990 | Raible et al. | |
| 4,976,590 | A | 12/1990 | Baldwin | |
| 5,057,081 | A | 10/1991 | Sunderland | |
| 5,067,879 | A | 11/1991 | Carpenter | |
| 5,082,429 | A | 1/1992 | Soderquist et al. | |
| 5,088,522 | A | 2/1992 | Rath et al. | |
| 5,127,908 | A * | 7/1992 | Walker et al. | 604/153 |
| 5,147,312 | A | 9/1992 | Walker et al. | |
| 5,215,450 | A | 6/1993 | Tamari | |
| 5,222,880 | A | 6/1993 | Montoya et al. | |
| 5,342,182 | A | 8/1994 | Montoya et al. | |
| 5,468,129 | A | 11/1995 | Sunden et al. | |
| 5,482,447 | A | 1/1996 | Sunden et al. | |
| 5,486,099 | A * | 1/1996 | Montoya | 417/477.13 |
| 7,547,200 | B2 * | 6/2009 | O'Mahony et al. | 417/477.2 |
| 2003/0132552 | A1 | 7/2003 | Gamble et al. | |
| 2004/0096348 | A1 * | 5/2004 | Doig | 417/477.1 |
| 2004/0213685 | A1 | 10/2004 | Klein | |

* cited by examiner

*Primary Examiner* — Charles Freay
(74) *Attorney, Agent, or Firm* — Stetina Brunda Garred & Brucker

(57) ABSTRACT

A peristaltic pump system includes elastomeric pump tubing and a roller pump. The pump tubing has a pumping segment and an inlet segment. The inlet segment has an inlet segment outer diameter. The pumping segment has a pumping segment outer diameter less than the inlet segment outer diameter. The roller pump has a roller assembly and a roller assembly housing. The roller assembly is disposed within the roller assembly housing and engaged with the pumping segment within the roller assembly housing. The roller assembly housing has an inlet gap formed through the roller assembly housing. The inlet gap defines an inlet gap inner diameter smaller than the pumping segment outer diameter. The inlet gap is adapted to frictionally receive the inlet segment for aligning the pump tubing with a roller assembly and mitigate longitudinal movement of the pump tubing into the roller assembly housing.

16 Claims, 12 Drawing Sheets

Fig. 7A
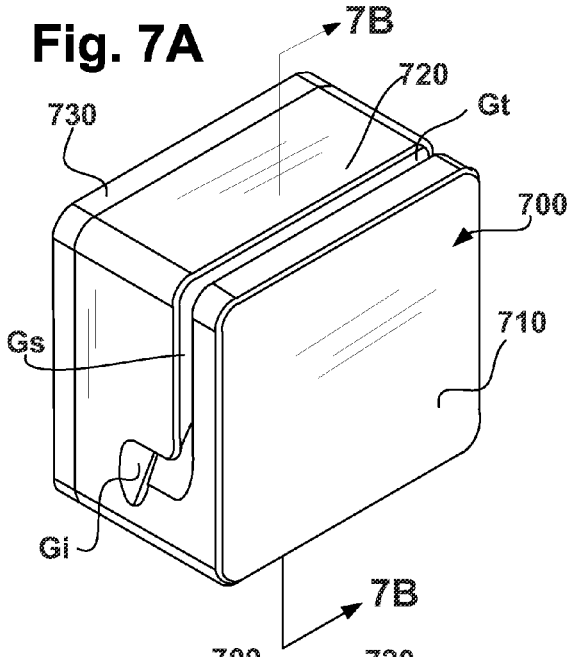
Fig. 7D
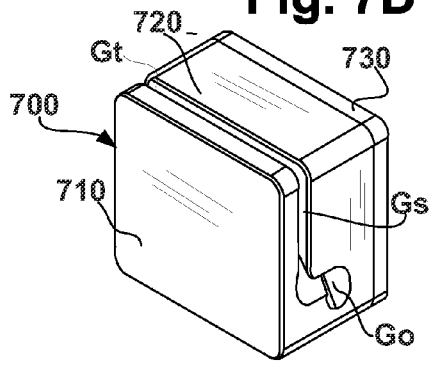
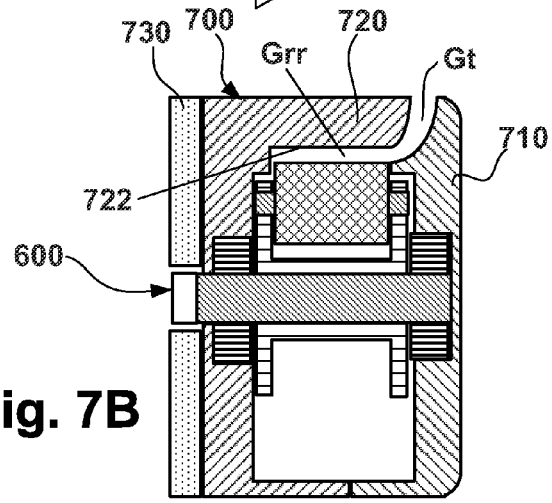
Fig. 7B
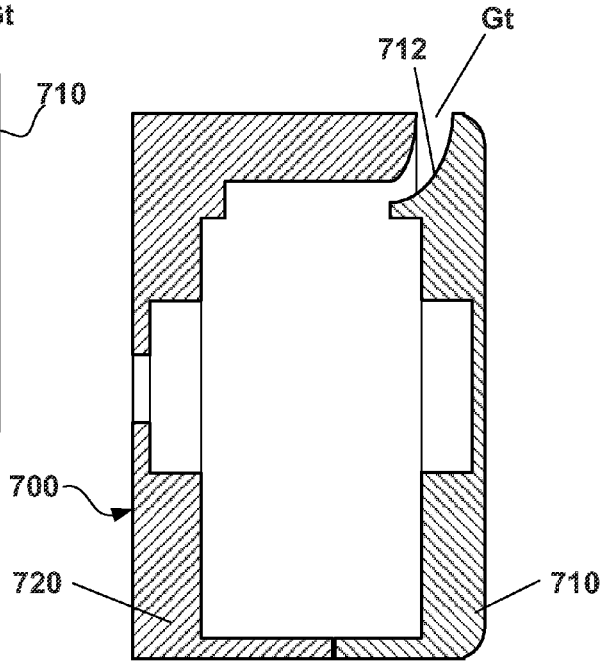
Fig. 7C

9AX
Gt
190
700
100
9AX
712
190
Gt
714
700

9BX
Gt
700
Gs
190
190
Gi
9BX

720
Grr
190
Gt
714
710
610
600
700

140
S
100
130
9CX
Gt
700
Gs
Gi
140
S
9CX 100
190
720
Grr
140
Gt
610
710
600
700

Fig. 11A
Prior Art
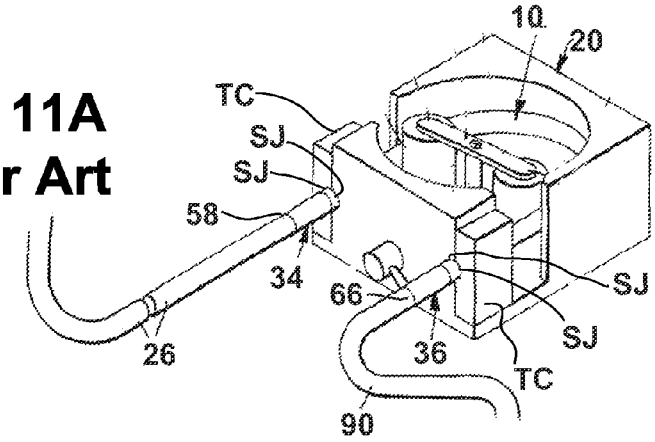
Fig. 11B
Prior Art
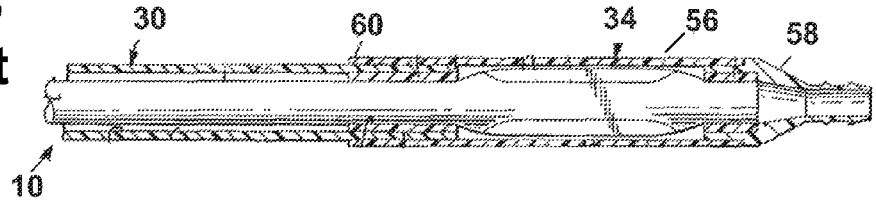
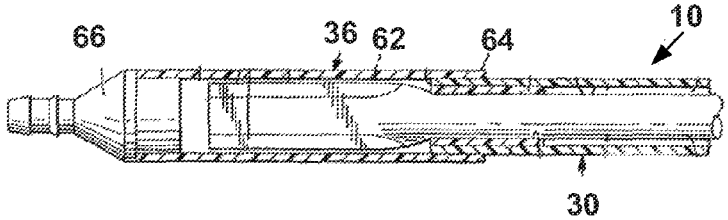
Fig. 11C
Prior Art
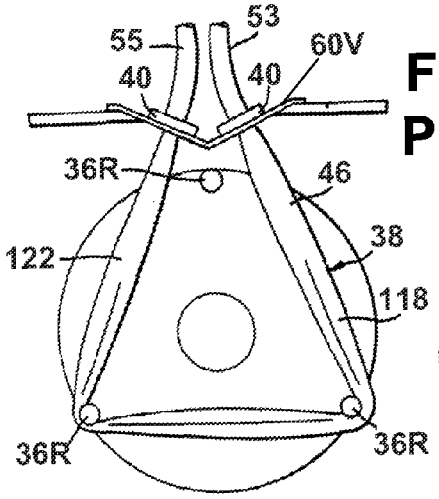
Fig. 12A
Prior Art
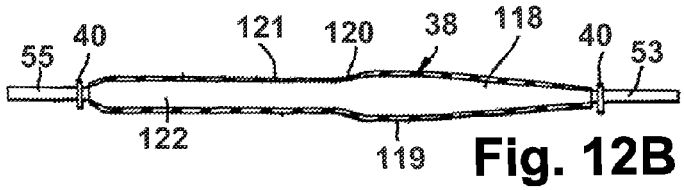
Fig. 12B
Prior Art

PERISTALTIC PUMP TUBING WITH STOPPER AND COOPERATIVE ROLLER ASSEMBLY HOUSING HAVING NO MOVING PARTS

CROSS-REFERENCE TO RELATED APPLICATIONS

This non-provisional patent application claims the benefit of U.S. Provisional Patent Application Ser. No. 61/150,997, filed on Feb. 9, 2009, entitled "PERISTALTIC PUMP TUBING WITH STOPPER AND COOPERATIVE ROLLER ASSEMBLY HOUSING HAVING NO MOVING PARTS", the entire contents of which are incorporated herein by reference.

STATEMENT RE: FEDERALLY SPONSORED RESEARCH/DEVELOPMENT

Not Applicable

BACKGROUND

This invention relates to peristaltic pumps, and more particularly to safety and use improvements thereto.

A peristaltic pump consists of two principal component parts, the tubing and pumphead assembly. These parts must be mutually compatible in order for the peristaltic pump to be functional. A peristaltic pump is a mechanical pump in which pressure is provided by the movement of a constriction along a tube, as in biological peristalsis. The constriction or pumping action is usually provided by the movement of one or more rollers rotatably mounted on a fixture which in turn rotates on an axis. The movement of the rollers along a segment of the tube within the pump raceway propels fluid through the tubing. There are several interrelated factors that determine the pumping rate including the dimensions and elastic quality of the tubing, as well as the rate of compression applied by the pump rollers. The pump tubing is placed into the raceway and traditionally fixed by means of clamps, flanges or fixtures. Synonyms for peristaltic pump are roller pump, tube pump, and hose pump.

The rate of fluid flow produced by a peristaltic pump is a function of 1) the angular velocity of the roller assembly and 2) the volume of fluid contained within the tubing delimited by constrictions produced by two consecutive rollers. An increase the inside diameter of the pump tubing within the pump raceway will increase the volume of fluid pumped with each cyclic compression of the tubing. Traditional peristaltic roller tubing includes an inlet end, a central pumping segment which interacts with the rollers, and an outlet end. An example of a peristaltic pump used for tumescent infiltration is the Klein Pump (HK Surgical, Inc, US Patent Publication No. 2004/0213685, filed October 2004 to Klein).

The overall functional efficacy of a peristaltic pump system depends on a combination of both the pump's roller assembly and the pump tubing. Pump tubing is at least as important as the pump motor and roller housing in terms of overall performance and reliability.

Tumescent Local Anesthesia (TLA): is a very dilute solution of lidocaine (≦1 gram per liter) and epinephrine (≦1 milligram per liter) with sodium bicarbonate (10 milliequivalents per liter) in a crystalloid solution such as physiologic saline or lactated Ringer's solution. Tumescent liposuction is surgical technique for doing liposuction totally by local anesthesia using tumescent local anesthesia. Tumescent liposuction using TLA is far safer than liposuction performed under general anesthesia. Tumescent or tumescence refers to the state of being swollen and firm. Tumescent liposuction can involve the infiltration of several liters of tumescent local anesthesia into the targeted areas of subcutaneous fat. In addition to large volume liposuction totally by local anesthesia, surgical applications of TLA include a growing list of diverse therapeutic procedures. For example, in patients with symptomatic varicosity of a greater saphenous vein, endovenous laser ablation (EVLA) cannot be safely performed without tumescent local anesthesia infiltrated into the peri-venous compartment of the greater saphenous vein. Because the tumescent fluid acts as a heat sink as well as a local anesthetic, TLA protects nerves and arteries anatomically adjacent to the saphenous vein compartment from heat trauma. TLA is an essential aspect of endovenous laser ablation of the greater saphenous vein. There is a growing list of complex therapeutic (not cosmetic) surgical procedures which are now accomplished totally by local anesthesia using TLA, thereby avoiding the risks of general anesthesia. For example, in elderly patients whose cardiopulmonary status makes them poor candidates for the use of general anesthesia, TLA is now employed for mastectomy totally by local anesthesia (Carlson G W. *Total mastectomy under local anesthesia: the tumescent technique*. Breast J. 11:100-2, 2005), and arterial surgery for subclavian steal syndrome totally by local anesthesia (Mizukami T, Hamamoto M. Tumescent local anesthesia for a revascularization of a coronary subclavian steal syndrome. Ann Thorac Cardiovasc Surg. 13:352-4, 2007). In all of these clinical applications of TLA surgeons use a peristaltic pump to accomplish the infiltration of tumescent local anesthesia. In order to avoid surgical site infections (SSI) it is essential that the peristaltic tubing be sterile and disposable when used in surgical settings.

Peristaltic pumps typically employ a mechanical system for holding the tube securely in place during roller rotation which consists of several moving parts such as clamps, attachment flanges, connection brackets, or special fixtures that attach to the metal, plastic or glass connectors that join sequentially connected segments of tubing and retain the tubing in a fixed position with respect to the roller assembly housing. Some pump designs employ a clamping mechanism designed to squeeze the tube and hold it in place by virtue of a crimping deformation of the tube. There is need for a simplified roller assembly housing design for securing a peristaltic tube within the roller assembly housing which has no moving parts and only two parts exclusive of the roller assembly, and protects fingers of personnel against injury and protects the roller assembly from damage due to encounters with extraneous or foreign objects.

BRIEF SUMMARY

An aspect of the invention relates to peristaltic pumps, and more specifically to peristaltic roller pumps having means to simplify and facilitate loading and unloading of tubing in a safe manner. The present invention consists of two mutually dependent innovations related to the tubing and to roller assembly housings of peristaltic pumps. The simplified design of the pump tubing with stopper element allows the tubing to be automatically secured within the roller assembly housing and to concomitantly be precisely aligned with the pump rollers. The simplified design of the roller assembly housing has only two parts and no moving parts yet it automatically aligns the novel pump tubing with respect to the rollers, holds the tubing without clamps or connecting members. This may also tend to prevent both injury due to finger entanglement during the tube insertion process and damage to the rollers during pump operation.

A peristaltic pump system includes elastomeric pump tubing and a roller pump. The pump tubing has a pumping segment and an inlet segment. The inlet segment has an inlet segment outer diameter. The pumping segment has a pumping segment outer diameter less than the inlet segment outer diameter. The roller pump has a roller assembly and a roller assembly housing. The roller assembly is disposed within the roller assembly housing and engaged with the pumping segment within the roller assembly housing. The roller assembly housing has an inlet gap formed through the roller assembly housing. The inlet gap defines an inlet gap inner diameter smaller than the pumping segment outer diameter. The inlet gap is adapted to frictionally receive the inlet segment for aligning the pump tubing with a roller assembly and mitigate longitudinal movement of the pump tubing into the roller assembly housing.

According to various embodiments, the inlet segment may have a constant wall thickness along a length of the pumping segment. The pumping segment may have a varying wall thickness along a length of the pumping segment. The inlet segment outer diameter may be constant along a length of the pumping segment. The pumping segment outer diameter may vary along a length of the pumping segment. The pump tubing may further have an outlet segment with the pumping segment disposed between the inlet segment and the outlet segment, the outlet segment is engaged with the pumping segment. The outlet segment may have an outlet segment outer diameter that is constant along a length of the outlet segment. The outlet segment may have an outlet segment outer diameter that is the same as the pumping segment outer diameter. The inlet segment may have a wide portion and a narrow portion with the wide portion disposed between the narrow portion and the pumping segment. The inlet segment outer diameter may be disposed at the wide portion. An outer diameter of the narrow portion may be less than the inlet segment outer diameter. The outer diameter of the narrow portion may be the same as the outer diameter of the outlet segment. A wall thickness of the wide portion may be greater than a wall thickness of the pumping section. The inlet segment may include a stopper ring disposed circumferentially about the tubing. The stopper ring defines the inlet segment outer diameter. The stopper ring may be torus-shaped. The inlet segment may include a semi-tubular segment disposed circumferentially about the tubing. The semi-tubular segment defines the inlet segment outer diameter. The pumping segment and the inlet segment may be formed of a single continuous piece of material.

The tubing may be a single use, sterile, disposable plastic tubing having medical applications as well as other commercial, industrial, laboratory and clinical applications.

In one embodiment, the tubing can be extruded as a single component with an integrated stopper element thereby eliminating the multiple component parts. In another embodiment the pump tubing can have two functional pumping segments with different inside diameters (ID) such that the larger ID can be used to pump large volumes at a relatively high rate and the smaller ID can be used to pump relatively small volumes of fluid slowly with precision and finesse.

An aspect of the invention discloses a simplified peristaltic roller pump system consisting of interrelated novel pump tubing and novel roller assembly housing. A peristaltic roller pump consists of two distinct and essential elements, pump tubing and pumphead assembly, which together are sufficient for pumping action.

The present inventive pump tubing may consist of a length of elastomeric tubing having an inlet segment, a stopper segment, a pumping segment compressed by the pump rollers and an outlet segment. The stopper element is an element of the tubing having an outside diameter which is larger than the inside diameter of inlet gap Gi (see FIG. 7) of the roller assembly housing 700. The function of the stopper element is to become snuggly wedged within the inlet gap Gi, thereby positioning and aligning the tubing with respect to the rollers, and preventing the tubing from migrating or walking through the pumphead assembly as a result of the vector forces exerted on the tubing by the rollers. There are various possible embodiments of the tubing and the stopper element some of which are described in detail below.

The disclosed pumphead assembly consists of a roller assembly housing and a roller assembly (See FIG. 6-8). The roller assembly, not part of the present invention, can be a standard roller assembly such as that of the Watson-Marlow pump models 313 and 314. The Watson-Marlow pumphead assemblies have a standardized attachment plate (not part of this invention) which is permanently affixed to the pump motor housing and allows detachable attachment of the roller assembly housing to the pump house assembly.

The inventive roller assembly housing can be manufactured as two attachable but non-movable parts, the posterior raceway-part and the anterior inlet-ramp-part. The inventive tubing can be manufactured as a single part. The inventive design reduces the complexity and the expense of the manufacturing process and improves safety. The tubing element and roller assembly housing element are functional and inventive if and only if both elements are simultaneously considered as a unique single entity.

All aspects discussed herein apply to any application of peristaltic pumping currently known in the art or developed in the future.

The wall thickness of the tubing can be constant or variable. The outside diameter of the tubing can be constant of variable, and the inside diameter of the tubing can be constant or variable.

The novel roller assembly housing eliminates numerous parts from prior-art roller pumps and provide a safer and simpler method for inserting the tubing between the rollers and the pump raceway. A method for inserting a tube set into a roller pumphead assembly is provided wherein the tubing has a non-elastic distal Luer connector and a proximal non-elastic IV-bag spike for connecting IV bag and elastomeric pump tubing.

Because the spike and the Luer connector both have ODs which can be larger than the minimum gap between the rollers and the roller raceway within the peristaltic roller assembly housing if they are drawn into the roller assembly they would be crushed or they would be damage the roller assembly.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 7A is a perspective view of the roller assembly housing 700 together with the prior art attachment plate 730 and section lines indicating a midline cross-sectional view FIG. 7B. FIG. 7C shows cross sectional view of 710 and 720. FIG. 7D shows the outlet gap Go.

FIGS. 11A, 11B and 11C are views of prior art disclosed by Parrott in U.S. Pat. No. 4,767,289, Peristaltic Pump Header, issued Aug. 30, 1988.

FIGS. 12A and 12B are views of prior art disclosed by Montoya et al, U.S. Pat. No. 5,342,182, Self Regulating Blood Pump with Controlled Suction, issued Aug. 30, 1994.

DETAILED DESCRIPTION

Illustrative embodiments of an improved design for peristaltic roller pump tubing and a roller assembly housing are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1A:
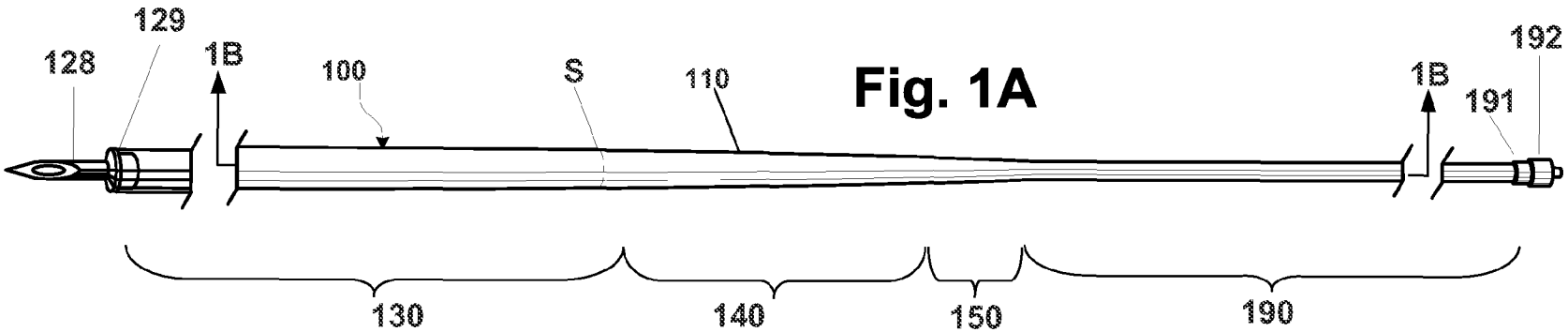
FIG. 1A is a perspective view of a peristaltic roller pump tube having a single transitional segment with section lines indicating a partial longitudinal cross-section view of the tube.
Figure 1B:
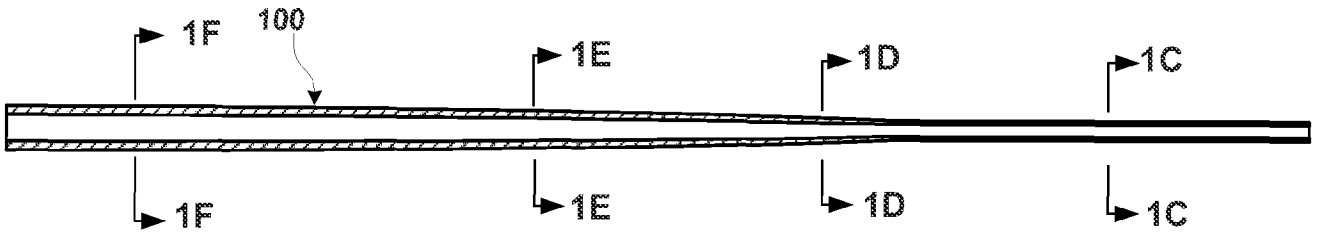
FIG. 1B is a partial cross-sectional view of the tube 1A with section lines indicating transverse cross-sectional views at the level of the outlet segment FIG. 1C, transitional segment with varying wall thickness FIG. 1D, pumping segment consisting of a transitional segment with constant wall thickness and variable outside diameter FIG. 1E and the inlet segment FIG. 1F.

FIG. 1A is a perspective view of a peristaltic roller pump tube assembly 100 with section lines indicating a partial longitudinal cross-section view of the tube FIG. 1B, an IV bag spike 128 attached to the tubing inlet 129, and a male Luer lock connector 192 attached to a tubing outlet 191. Such a single piece of elastomeric pump tubing 110 is composed of an inlet segment 130, a pumping segment 140, a transition segment 150, and an outlet segment 190. The embodiment illustrated in FIG. 1A has a single transitional segment 150.

The inlet segment 130 can have arbitrary wall thickness (WT) and outside diameter (OD) which is strictly greater than the maximal OD of the more distal tubing segments 140, 150, and 190. The pumping segment 140 can have a constant WT along its entire length which is preferably half the magnitude of gap Grr, the minimum distance of the gap between the concave surface of a raceway and the surface of pump rollers of a roller pump means, as shown in FIG. 7B. The transitional segment 150 and a significant length of the proximal portion outlet segment 190 must have a wall thicknesses strictly less than the half the magnitude of the roller raceway gap Grr. Furthermore the entire length of segments 140 and 150 as well as a significant length of the proximal portion of outlet segment 190 must have an OD which is strictly less than the OD of an inlet gap Gi or an outlet gap Go (shown in FIG. 7D) of the roller assembly housing.

The pumping segment 140 of the pump tubing 110 is located between the inlet and outlet segments 130, 190. The pumping segment 140 is the segment inserted into the pump raceway and cyclically compressed by the pump rollers. The pumping segment 140 is responsible for the pumping efficiency of a peristaltic roller pump tube assembly 100. The larger the internal diameter (ID) of the pumping segment 140, the greater will be the volume of fluid ejected with each cyclic compression of the pump tube assembly 100.

The inlet segment 130 of the pump tubing 110 is the proximal or vacuum segment of the pump tubing 110. The fluid pressure within the inlet segment 130 is relatively low. Fluid flows into the inlet segment 130 from a reservoir source, entering into the pump tubing 110 via the proximal end and is drawn distally by the negative pressure generated by the peristaltic roller pump assembly 100.

The outlet segment 190 of the pump tubing 110 is the distal or pressure segment of the tubing. The outlet segment is bounded proximally by a pumping segment of the pump tubing 110. Fluid flows from pumping segment 140 into the outlet segment 190 being pushed by the positive pressure generated by the peristaltic pump rollers.

As used herein the term stopper means or element S, the function of which is illustrated in FIGS. 1A, 1B, 7A and 9C, is a non-tangible circumferential annular line of points encircling the inlet tubing segment 130, and is such that S has an diameter (Ds) which is larger than the inside diameter (ID) of the inlet gap Gi of the roller assembly housing. Furthermore stopper element S is located at the first point on tubing 110 proximal to tubing segments 140, 150, and 190 where the OD is strictly greater than the inside diameter (ID) of the inlet gap Gi of the roller assembly housing.

During the tube-loading process, a length of the proximal portion of outlet segment 190, having an OD which is smaller than the ID of Gi, is manually inserted and pulled into the roller assembly housing through a top gap Gt, then downward though side gaps Gs, and then, with the roller motor slowly rotating in the forward direction, the tubing is drawn through the inlet gap Gi and out through the outlet gap Go (not shown) of roller assembly housing by vector forces exerted by the roller rotation. When the larger diameter Ds of the stopper element S encounters the smaller ID of the inlet gap Gi of the roller assembly housing, the tubing proximal to the stopper element S becomes snuggly wedged in the inlet gap Gi thereby securely holding the roller tubing 110 in place and aligning the pumping segment of the roller tubing 110 with respect to the rollers.

Figure 1C:
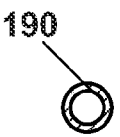
FIG. 1G is perspective view of tube assembly 100 with stopper element S and sliding stopper element SS together with the sliding stopper ring 101 located distally on the outlet segment 190 near the male Luer lock connector 192. The section lines 1I indicate the cross sectional view FIG. 1I showing the sliding stopper ring 101 fitting loosely around the outlet segment 190.
FIG. 1H shows the sliding stopper ring 101 fitting snuggly around the sliding stopper element SS with section line 1J indicating the cross sectional view FIGS. 1J, and 1K indicates the enlarged view FIG. 1K.
Figure 1D:
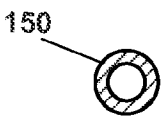
Figure 1E:
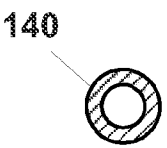
Figure 1F:
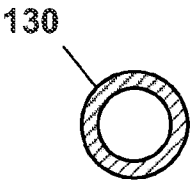

FIG. 1B is a partial cross-sectional view of the tube assembly 100 together with section lines indicating transverse cross-sectional views at the level of the outlet segment 190 (FIG. 1C), transitional segment 150 with varying wall thickness (FIG. 1D), pumping segment 140 with constant wall thickness and variable outside diameter (FIG. 1E), and the inlet segment 130 having constant OD and constant WT 130 (FIG. 1F).

Figure 1G:
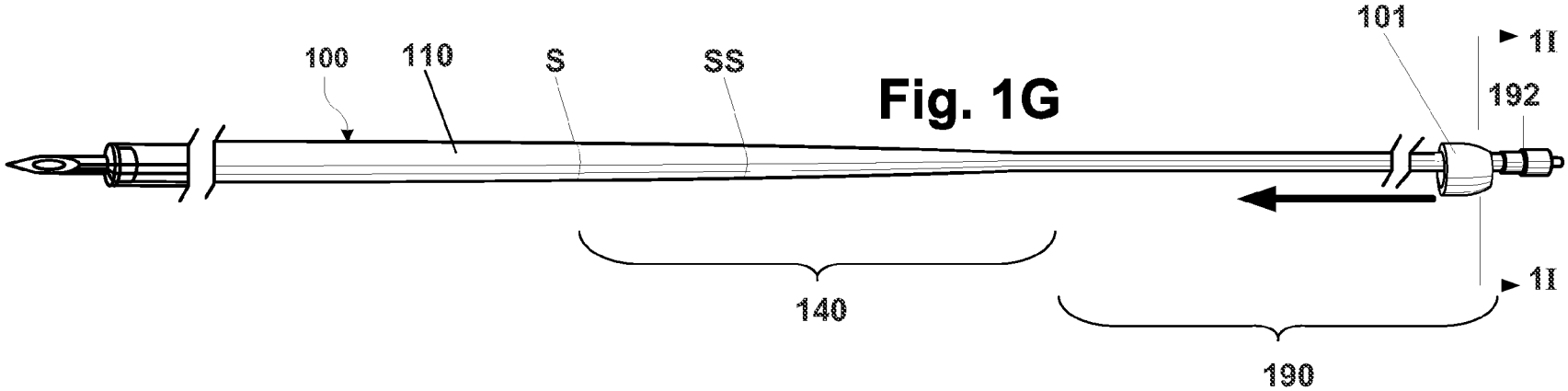

FIG. 1G shows tubing assembly 100 with an annular or torus-shaped sliding stopper ring 101 situated on the distal outlet segment 190 located near the Luer lock connector 192. The sliding stopper ring 101 has an inside diameter that is equal to the outside diameter at a point on the tube 110 designated as the sliding stopper element point SS which is located on the pumping segment and is distal to stopper element S. The OD at SS is strictly less than the OD at S. The position of the sliding stopper ring 101 can be moved in the direction of the large arrow toward the point SS. The section lines 1I indicate the cross sectional view of the outlet segment 190 where the sliding stopper ring 101 fits loosely about segment 190.

Figure 1H:
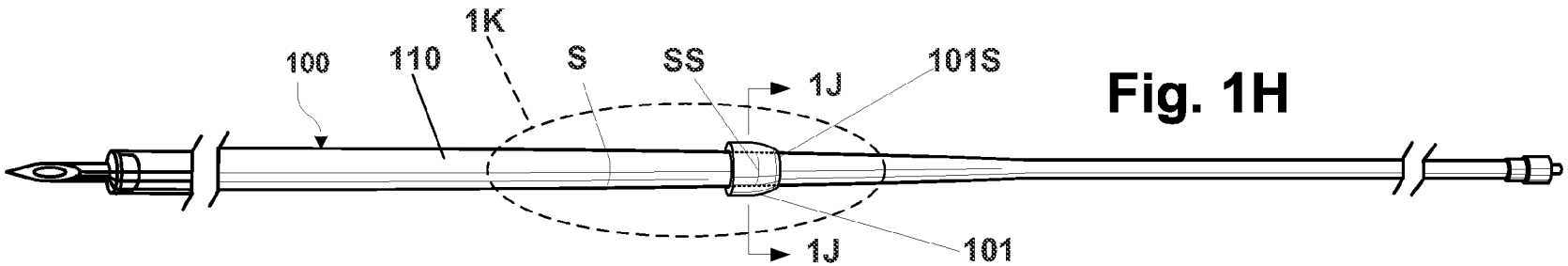
Figure 1I:
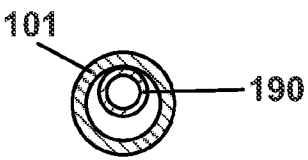

FIG. 1H shows the tubing 110 of the tubing assembly 100 with the sliding stopper ring 101 situated proximally on the pumping segment 140 and fitting snuggly at the point SS. The OD at SS is strictly less than the OD at stopper element S. The section lines 1J indicate the cross sectional view of the pumping segment 140 and snuggly fitting sliding stopper element 101.

Also shown in FIG. 1H is the sliding stopper element 101S located on the stopper ring 101. The sliding stopper element 101S is a non-tangible circumferential annular line of points encircling a distal portion of sliding stopper ring 101, and is such that 101S has an inside diameter (Ds) equal to the diameter Ds of stopper element S. The section line 1J indicates the cross sectional view of FIG. 1H at the level of the point SS and sliding stopper ring 101.

Figure 1J:
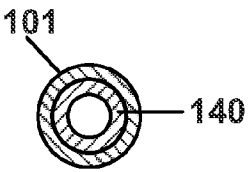

FIG. 1J at the level of the point SS and sliding stopper ring 101 where the inner member is a cross sectional view of the pumping segment 140 and the outer member a cross sectional view of sliding stopper ring 101.

Figure 1K:
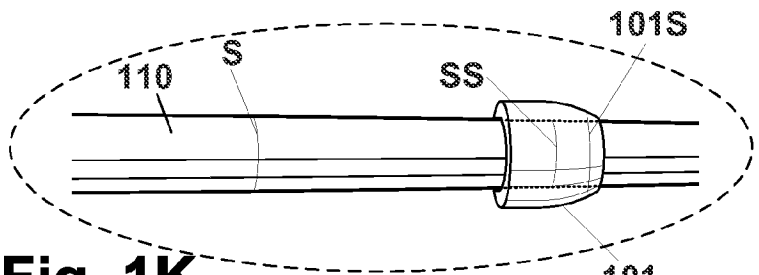

FIG. 1K is an enlarged detailed view of FIG. 1H showing relative positions of S and SS, as well as the sliding stopper element 101S on the sliding stopper ring 101.

As used herein the outside diameter (OD) of a tube is the diameter of the circle congruent with the outer surface of a circular tube. As used herein the inside diameter (ID) of a tube is the diameter of the lumen of a tube having a circular-cross-section. The ID of the pumping segment 140 of the pump tubing 110 is an important factor in determining the volume of fluid that is pumped in one 360 degree cycle of the peristaltic pump. For any given rate of roller rotation the fluid flow rate is maximized by using a tube having the largest tube ID. To achieve higher pump precision, one should use tubing having a relatively small ID with the pump rollers rotating at a relatively high rate.

As used herein the wall thickness (WT) is the thickness of the wall of a section of pump tubing 110. The wall thickness for the pumping segment 140 of tubing is typically at least half the minimal distance between the rollers and the roller raceway.

Figure 2A:
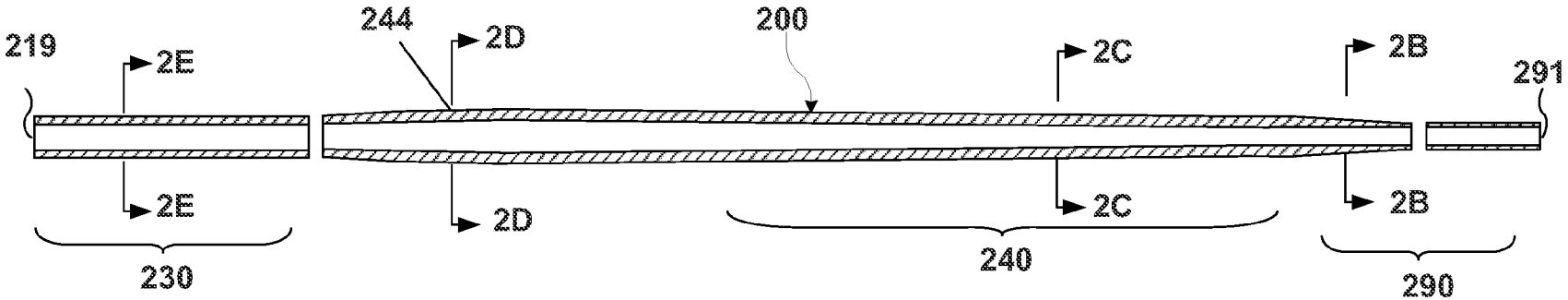
FIG. 2A is a longitudinal cross-sectional view of a peristaltic roller pump tube having two transitional segments with section lines indicating transverse cross-sectional views at the level of the outlet segment FIG. 2B, pumping segment consisting of a transitional segment with constant wall thickness and variable outside diameter FIG. 2C and FIG. 2D, and the inlet segment FIG. 2E. The wall thickness shown in FIG. 2B is significantly thinner than the wall thickness shown in FIG. 2E.
Figure 2B:
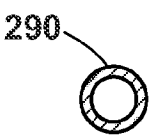
Figure 2C:
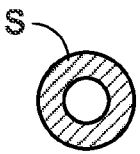
Figure 2D:
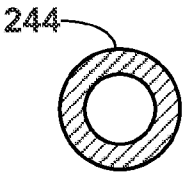
Figure 2E:
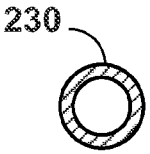

FIG. 2A shows a partial cross-section of another embodiment 200 of a roller pump tubing which prevents wrong-way or flip-flop tubing insertion into the roller pumphead assembly. Shown are section lines indicating cross-section views of the tubing at the level of the outlet segment 290, FIG. 2B, at the level of the pumping segment 240, FIG. 2C, at the point 244 on the tubing 101 where the largest OD is located, and at the level of the inlet segment 230, FIG. 2E. The wall thickness is constant along the pumping segment 240. The proximal inlet opening is 219 and the distal outlet opening is 291.

Figures 9A, 9B, 9C:
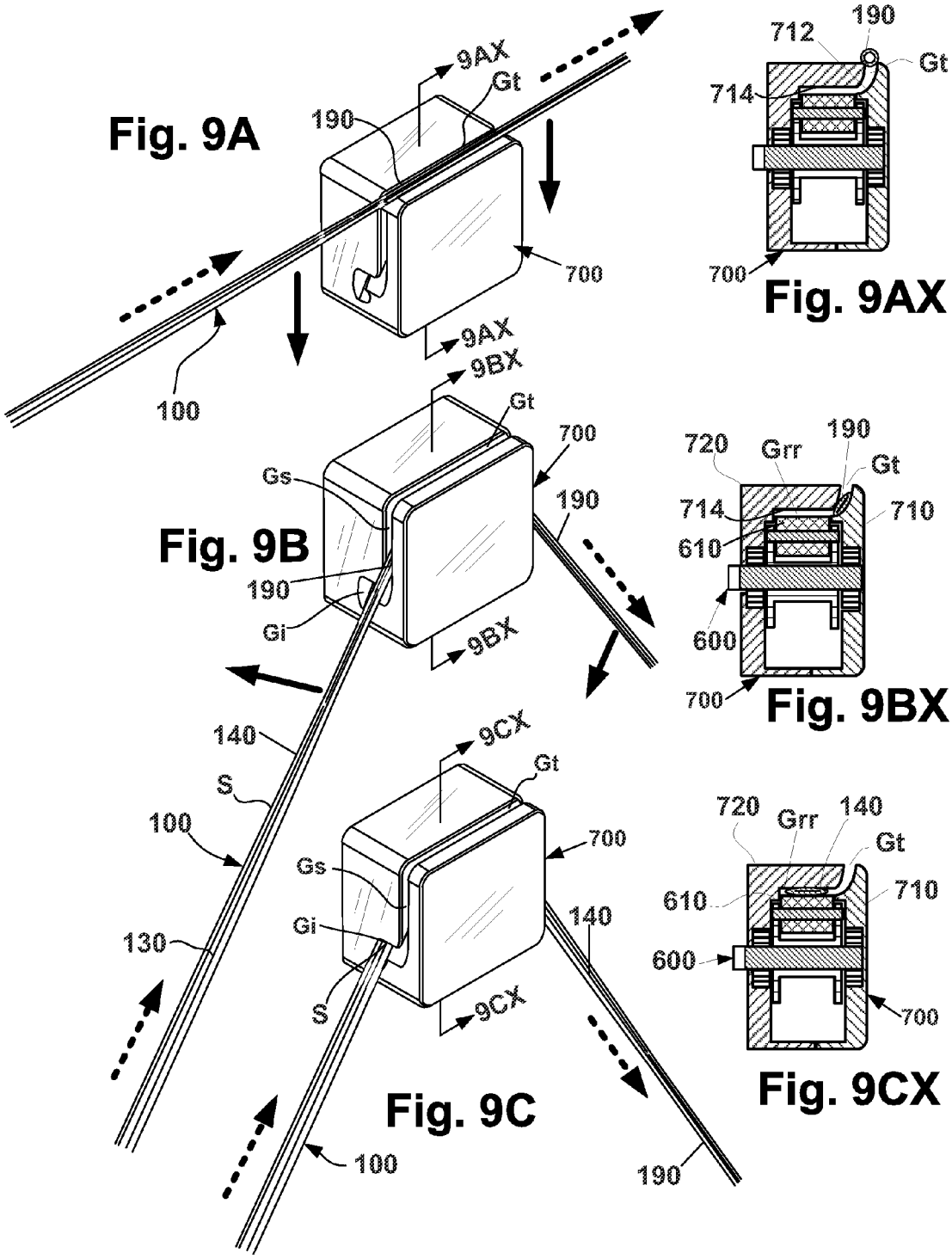
FIG. 9A is a perspective of a portion of the outlet segment 190 of pump tubing 100 entering the roller assembly housing 700 and section lines indicating a midline cross-sectional view FIG. 9AX.
FIG. 9B is a perspective of a portion of the outlet segment 190 of pump tubing 100 entering the roller assembly housing 700 and section lines indicating a midline cross-sectional view FIG. 9BX.
FIG. 9C is a perspective of a portion of the outlet segment 140 of pump tubing 100 entering the roller assembly housing 700 indicating the stopper element 146 wedged within the inlet gap Gi and section lines indicating a midline cross-sectional view FIG. 9CX.

In order to be able to insert a segment of the tubing into the roller assembly housing, the wall thickness of the segment is no greater than half the width of the top gap Gt, FIG. 9A. For example, if the wall thickness of the outlet segment 290 is less than half the width of the top gap Gt, then segment 290 fits inside top gap Gt and therefore may be inserted through Gt and into the space between the roller raceway and the rollers, referred to as the roller raceway gap Grr in FIG. 7B. On the other hand, if the wall thickness of a segment of the tube, for example the inlet segment 230, exceeds half the width of top gap Gt then it is not possible to insert the inlet segment 230 into the roller assembly housing.

In certain situations, such as extracorporeal blood circulation, serious injury may occur to the patient if the roller pump tubing is inserted into the roller assembly housing in the wrong direction, thereby possibly pumping blood from the patient rather than to the patient (see Parrott et al, U.S. Pat. No. 4,767,289, issued on Aug. 30, 1988). To prevent this type of error, the tubing is manufactured such that the wall thickness of the inlet segment exceeds half the width of the top gap Gt while the wall thickness of the proximal portion of the outlet segment is strictly less than half the width of the top gap Gt. Thus if the wall thickness of the inlet segment 130 is strictly greater than half of width of top gap Gt, then the WT of 130 is too large and prevents 130 being inserted through Gt. In other words, tube assembly is prevented from being inserted in the wrong or flip-flop direction into the roller assembly housing 700 (FIG. 9A).

Figure 3A:
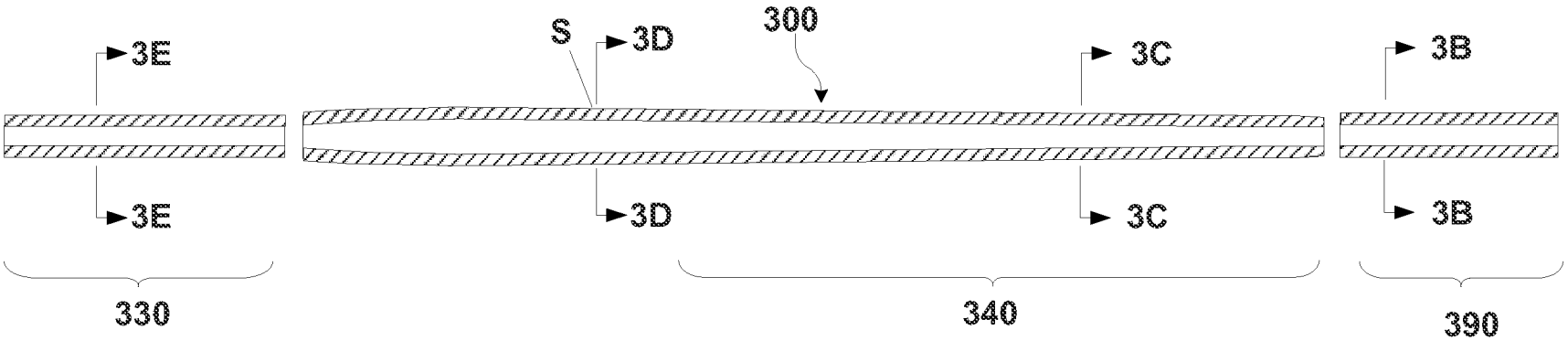
FIG. 3A is a longitudinal cross-sectional view of a peristaltic roller pump tube having constant wall thickness along its entire length and having two transitional segments with section lines indicating transverse cross-sectional views at the level of the outlet segment FIG. 3B, pumping segment consisting of a transitional segment and variable outside diameter FIG. 3C and FIG. 3D, and the inlet segment FIG. 3E.
Figure 3B:
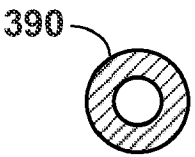
Figure 3C:
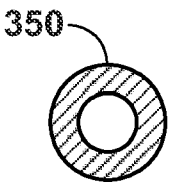
Figure 3D:
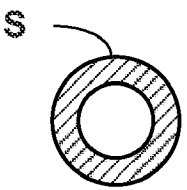
Figure 3E:
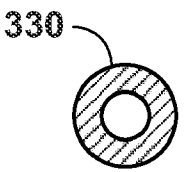

FIG. 3A demonstrates another embodiment of the roller pump tubing 300, with the approximate location of the stopper element S. In this design the wall thickness is constant throughout the length of the tubing, together with section lines which designate the cross-sectional views of the outlet segment 330, FIG. 3B, the pumping segment 340, FIG. 3C, and the outlet segment 390, FIG. 3E. Section lines 3D indicates the approximate point 344 of the maximum OD on the tubing 300, FIG. 3D.

Figure 4A:
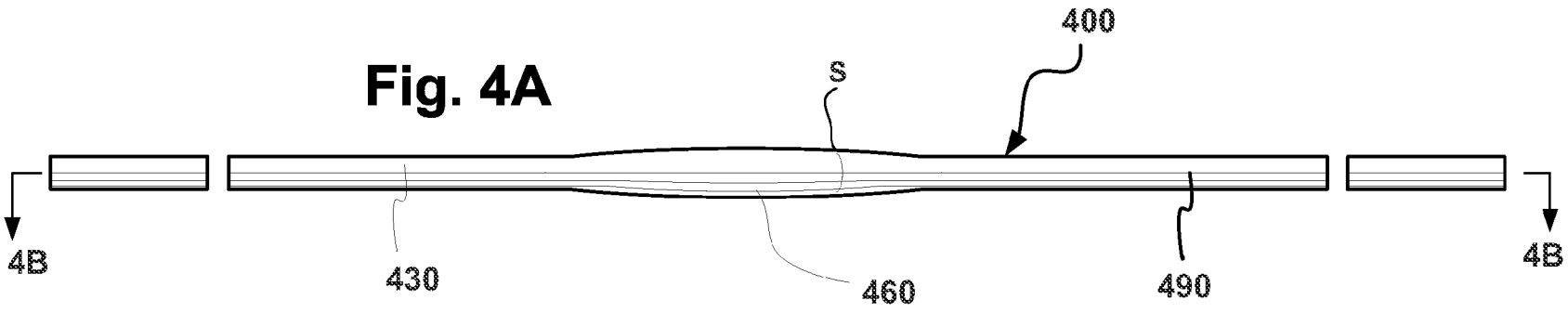
FIG. 4A is a perspective view of a peristaltic roller pump tube having a single bump segment formed from two transitional segments which functions as a stopper element together with section lines indicating a longitudinal cross-section view of the tube FIG. 4B.
Figure 4B:
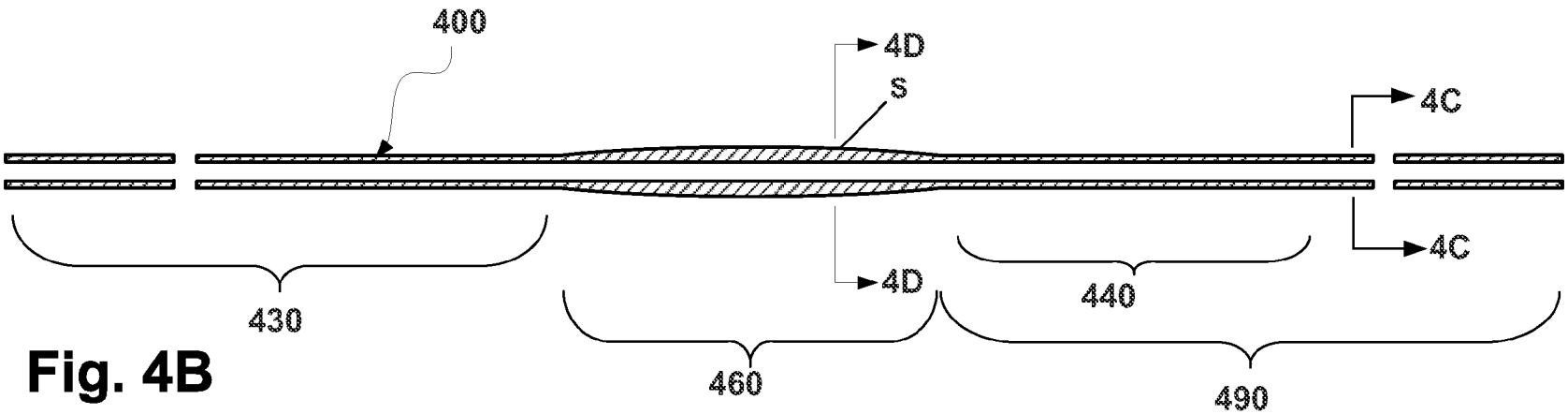
FIG. 4B is a longitudinal cross-sectional view of the tube FIG. 4A showing the stopper element 446 having an internal diameter which can be constant and having an wall thickness within the bump segment which can be constant or of increased thickness, also showing transverse cross-sectional views at the level of the outlet segment FIG. 4C, and the bump segment FIG. 4D.
Figure 4C:
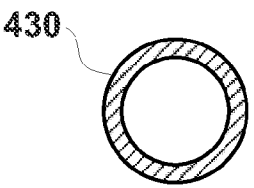
Figure 4D:
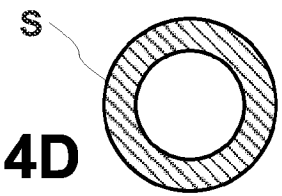

FIG. 4A is a perspective view of another embodiment of simplified peristaltic tubing wherein the inlet segment 430 and the outlet segment 490 have the same radial dimensions. Section lines 4B indicate a longitudinal cross-section view (FIG. 4B). The stopper element S is located on segment 460 which is formed during the tubing extrusion process as a localized enlargement of the tube OD. FIG. 4B shows a longitudinal cross-section view of tube 400 where the inner diameter thereof is substantially constant and equal along the entire length of the inlet segment 430, the pumping segment 440, and the outlet segment 490. The centrally located segment with an enlarged OD 460 is formed by the extrusion process to provide a stopper element S. Section lines 4C indicate the cross-section view (FIG. 4C) of the outlet segment 490. Section lines 4D indicates the cross-section view (FIG. 4D) of segment 460. Segment 460 which has an enlarged OD has an enlarged wall thickness and ID equal to the ID of all other segments of the tube. In an alternate embodiment the segment 460 with an enlarged OD has an ID that is larger than the ID of all other segments of the tube.

Figure 5A:
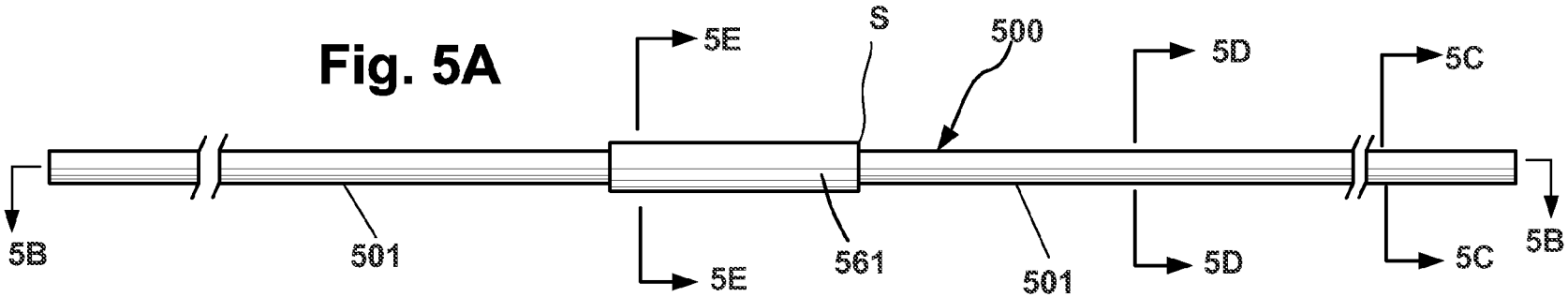
FIG. 5A is a perspective view of a peristaltic roller pump tube consisting of a simple round cylindrical tube without transitional segments showing a single bump segment which functions as a stopper element at point 546 together with section lines indicating a longitudinal cross-section view of the tube FIG. 5B, and transverse cross-section lines at the level of the outlet tube FIG. 5C, pumping segment FIG. 5D and stopper element FIG. 5E.

FIG. 5A is a perspective view of tube assembly 500 which is another embodiment of the present invention. The tube assembly 500 is constructed of a suitable elastomeric material such as durometer 60 PVC and consists of a single uniform tube 501 together with an additional external circumferential semi-tubular segment 561 providing a localized enlarged OD which functions as a stopper element S. Tubing 501 is subdivided into an inlet segment 530, a pumping segment 540, and outlet segment 590.

Figure 5B:
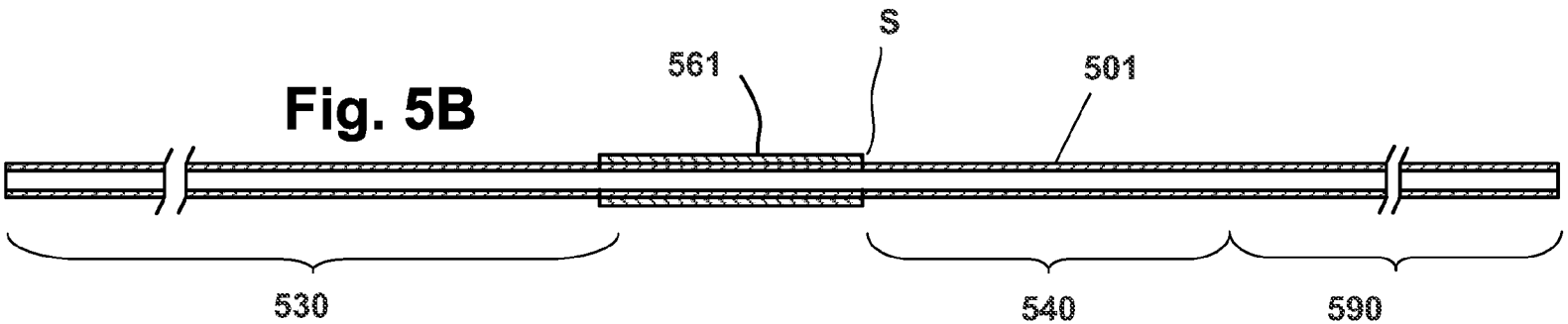
Figure 5C:
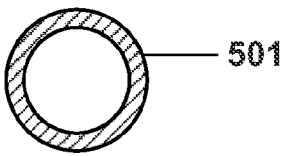
Figure 5D:
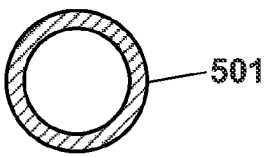
Figure 5E:
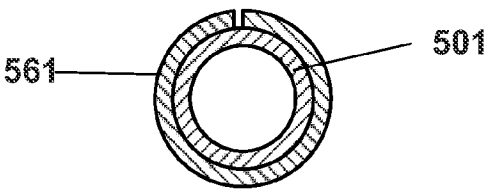

Section lines 5B indicate a longitudinal cross sectional view FIG. 5B of tube 500. Section lines 5C indicate a cross sectional view (FIG. 5C) of the outlet segment 590. Section lines 5D indicate cross sectional view (FIG. 5D) at the level of the pumping segment 540 of tube 501. Section lines 5E indicate cross sectional view of FIG. 5E of the tube assembly 500 at the level of segment 560. The external circumferential semi-tubular segment 561 has an ID equal to the OD of 501 wherein the tubular segment 561 is slit longitudinally, then opened, then wrapped around tube 501 and finally cemented in place.

Figure 6A:
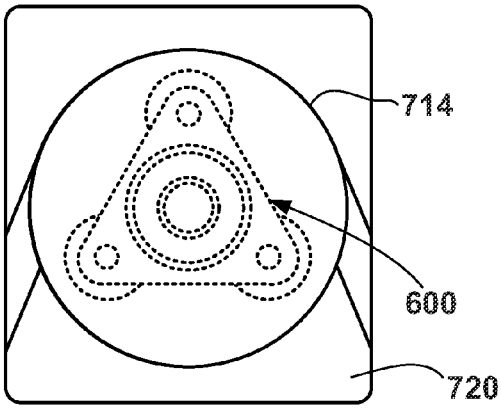
FIG. 6A is an anterior to posterior view of the raceway back cover 720 showing the relative position of the roller assembly 600.
Figure 6B:
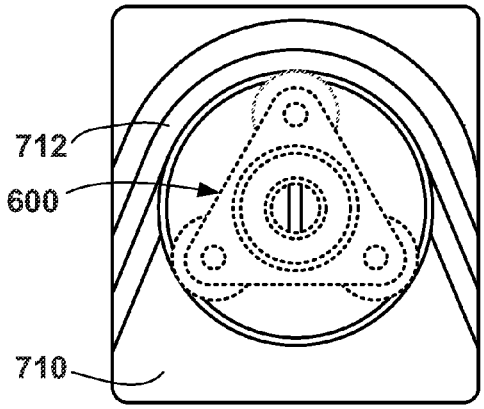
FIG. 6B is a posterior to anterior view of the front cover 710 with the tube ramp 712 and showing the relative position of the roller assembly 600.
Figure 6C:
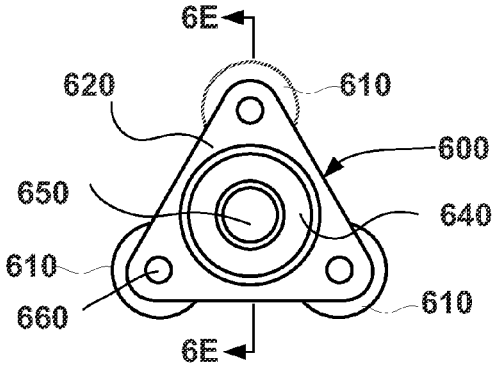
Fig. 6C Prior Art
FIG. 6C is a plane view of prior art roller assembly and section line indicating a longitudinal cross-sectional view FIG. 6E.
Figure 6D:
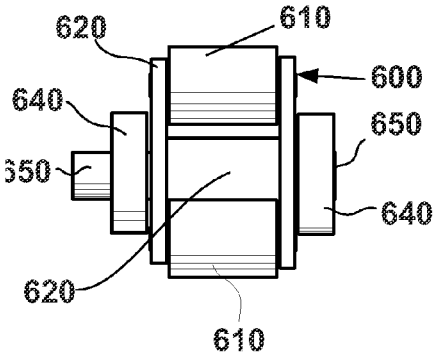
Fig. 6D Prior Art
FIG. 6D is a lateral view of the prior art roller assembly.
Figure 6E:
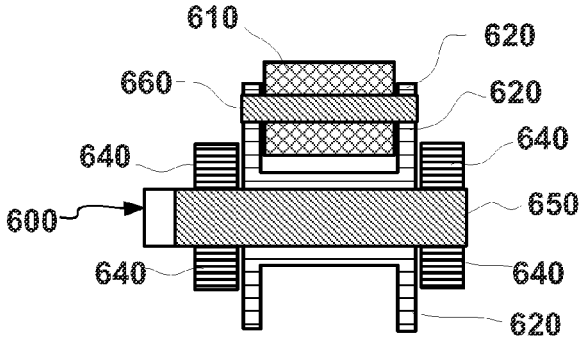
Fig. 6E Prior Art

FIG. 6A is an anterior-posterior (front to back) view the raceway back cover 720 of the pump roller means, or roller assembly housing 700 (FIG. 7A), showing the raceway 714 in relation to the roller assembly 600. FIG. 6B is a posterior-anterior (back to front) view of the front cover of the roller assembly housing 700 (FIG. 7A) showing the tube-ramp 712 in relation to the roller assembly 600. FIGS. 6C, 6D and 6E represent prior art peristaltic roller assembly 600 which is incorporated into the present invention. FIG. 6D is a side view of the roller assembly. FIG. 6C shows a frontal view of 600 with section lines 6E indicating the cross sectional view FIG. 6E. These figures show the rollers 610, roller axels 660, central axel 650, roller bracket 620 and a ball-bearing raceway assembly 640.

The roller assembly 600 may generally refer to and may include the combined assembly of cylindrical rollers, axels which pass through the rollers, brackets which secure the roller axels, main-axe ball bearings and the main axel with about which the brackets rotate and which is rotatably connected to the pump motor. For example see FIG. 6A, 6B, 6C.

The roller assembly housing 700 may generally refer to and may include the roller raceway and the associated structural components which securely hold and house the roller assembly together with the flanges and attachment members which securely hold the tubing in place and alignment with respect to the rollers. The roller assembly housing may also include a door assembly which opens to allow insertion of the tubing between the roller raceway and the roller assembly, and closes to prevent damage to the roller assembly and to provide protection against injury to the operator's fingers.

FIG. 7A, the inlet side, and FIG. 7D, the outlet side, are perspective views of the roller assembly housing 700 with section lines 7B indicating the cross sectional view FIG. 7B which shows the spatial relationship between roller assembly 600 and roller assembly housing 700. The roller assembly housing consists of only two parts: the tube-ramp front cover 710 and the raceway back cover 720. The attachment plate 730 detachably attaches 700 to the motor assembly housing 1000 (FIG. 10), and is prior art and not a part of the present invention. FIG. 7C is an enlarged view of FIG. 7B wherein the roller assembly 600 and the attachment plate 730 have been removed for clarity. The topological or geometrical relationship between the front cover 710 and the raceway back cover 720 creates a set of interconnected openings or gaps including the top gap Gt, the side gap Gs, the inlet gap Gi, outlet gap Go, roller raceway gap Grr and tube ramp 712 which allow the unique process of inserting, aligning and securing the pump tube inside 700, while requiring no moving parts. It is remarkable that the present inventive roller pump housing 700, while consisting of only two parts 710 and 720, has no moving parts. Nevertheless, any of the embodiments of the inventive pump tubing with stopper element, shown in FIGS. 1A, 2A, 3A, 4A, 5A together with the roller assembly housing 700 allow efficient and safe peristaltic pump function while minimizing manufacturing costs. A more detailed description of the process of inserting pump tubing into the roller assembly housing 700 will be described in detail in the discussion of FIG. 9A below.

Figure 8A:
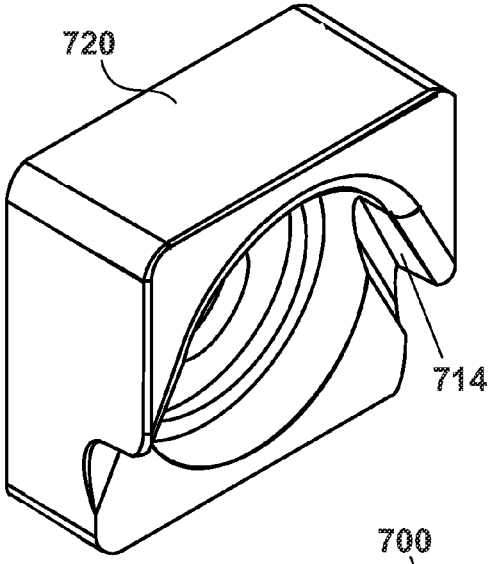
FIG. 8A shows a perspective view of the raceway back cover 720.
Figure 8B:
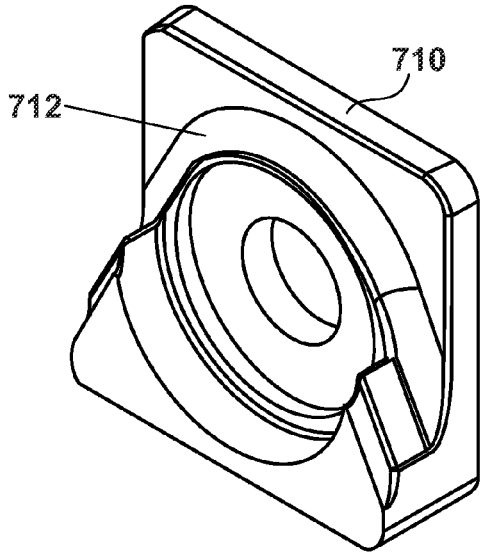
FIG. 8B is a perspective view of the front cover 710.
Figure 8C:
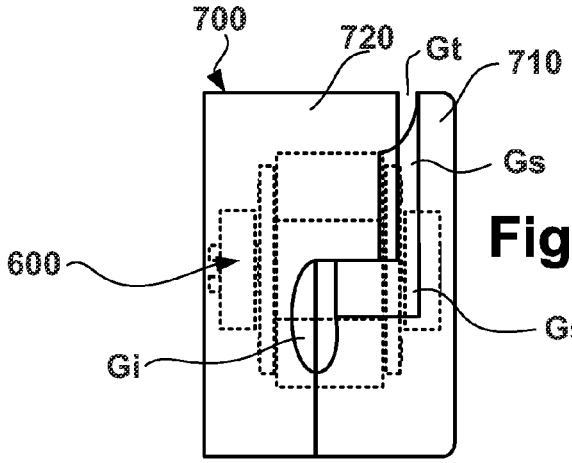
FIG. 8C is a lateral view of the roller assembly housing 700 showing a ghost view of the internally located roller assembly 600 together with the prior art attachment plate 730.
Figure 8D:
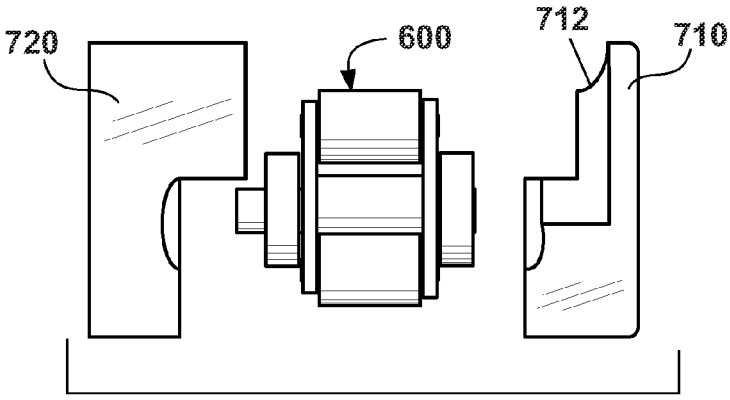
FIG. 8D is an exploded view of FIG. 8C.

FIG. 8A is a perspective view of the raceway back cover 720 of the roller assembly housing 700 (FIG. 7A) showing the raceway 714. FIG. 8B is a perspective view of the front cover 710 of the roller assembly housing 700 (FIG. 7A) showing the tube ramp 712. The front cover 710 and the back cover 720 are attached by any appropriate means, for example by means of nuts and bolts (not shown) or by cementing the two pieces together. FIG. 8C shows a side view of the roller assembly housing 700 together with the interior location of the roller assembly 600. FIG. 8D is an exploded view of FIG. 8C, and is intended to further illustrate the spatial relationship between the roller assembly 600 and the two constituent parts, the front cover 710 and the raceway back cover 720 of the roller assembly housing 700. FIGS. 8C, 8D provide views of the top gap Gt, the side gap Gs, the inlet gap Gi, and tube ramp 712.

FIGS. 9A, 9B, and 9C are perspective views of the roller assembly housing 700 and pump tubing 100 at three sequential stages in the process of inserting the tube 100 into roller assembly housing 700. FIGS. 9AX, 9BX, and 9CX are the respective cross sectional views of FIGS. 9A, 9B, and 9C, as indicated by section lines AX, BX and CX in FIGS. 9A, 9B, and 9C.

FIGS. 9A and 9AX show pump tube 100 positioned parallel to the top of the roller assembly housing 700 with outlet segment 190 of the pump tube 100 positioned longitudinally within the opening of the top gap Gt. If the wall thickness of 190 is less than half the width of top gap Gt then outlet segment 190 may be gently pulled into Gt in the direction of the heavy arrows shown in FIG. 9A. The first stage of the process of inserting and properly positioning the tube 100 in the roller assembly housing 700 consists actuating the slow rotation of the roller assembly so that a gentle vector force is applied to the tubing in the direction of the dashed arrows while the operator simultaneously pulls the outlet segment 190 down into the top gap Gt and down along the tube ramp 712 which is part of the front cover 710 toward the functional position of the tube 100 within roller raceway gap Grr. The roller raceway gap Grr is the space between the raceway 714 and roller 610 of the roller assembly 600. The roller assembly housing 700 is the assembly of two parts, the raceway back cover 720 and the front cover 710.

FIGS. 9B and 9BX show the outlet segment 190 of pump tube 100 having been pulled down into the side gap Gs and pulled toward the inlet gap Gi in the general direction of the heavy arrows while simultaneously the rotating rollers pull the tubing through the roller assembly housing 700 in the direction of the dashed arrows.

As the tubing is pulled through the roller assembly housing 700 the outlet segment 190 exits 700 while the pumping segment 140 and the inlet segment 130 are pulled toward the inlet gap Gi of the roller assembly housing 700. Simultaneously, as tube 100 is pulled downward along the tube ramp 712 of the front cover 710, it is also pulled backward toward the raceway 714, which is part of the back cover 720, and the roller raceway gap Grr.

FIGS. 9C and 9CX show tube 100 as having been pulled into its functional position within the roller raceway gap Grr between the roller 610 of the roller assembly 600 and the raceway 714 of the back cover 720. When the stopper element S on pump tube 100 reaches the inlet gap Gi, the stopper element becomes snuggly wedged into the aperture of the inlet gap Gi. With the stopper element S snuggly positioned within the inlet gap Gi, the pumping segment 140 of the tube assembly 100 is properly positioned within the roller raceway gap Grr and securely fixed within the roller assembly housing 700. With the proximal end of the inlet segment connected to a reservoir source of fluid (not shown), the continued rotation of the roller assembly produces efficient peristaltic pumping action of the fluid through the tubing assembly 100 and out its distal outlet end.

Figure 10:
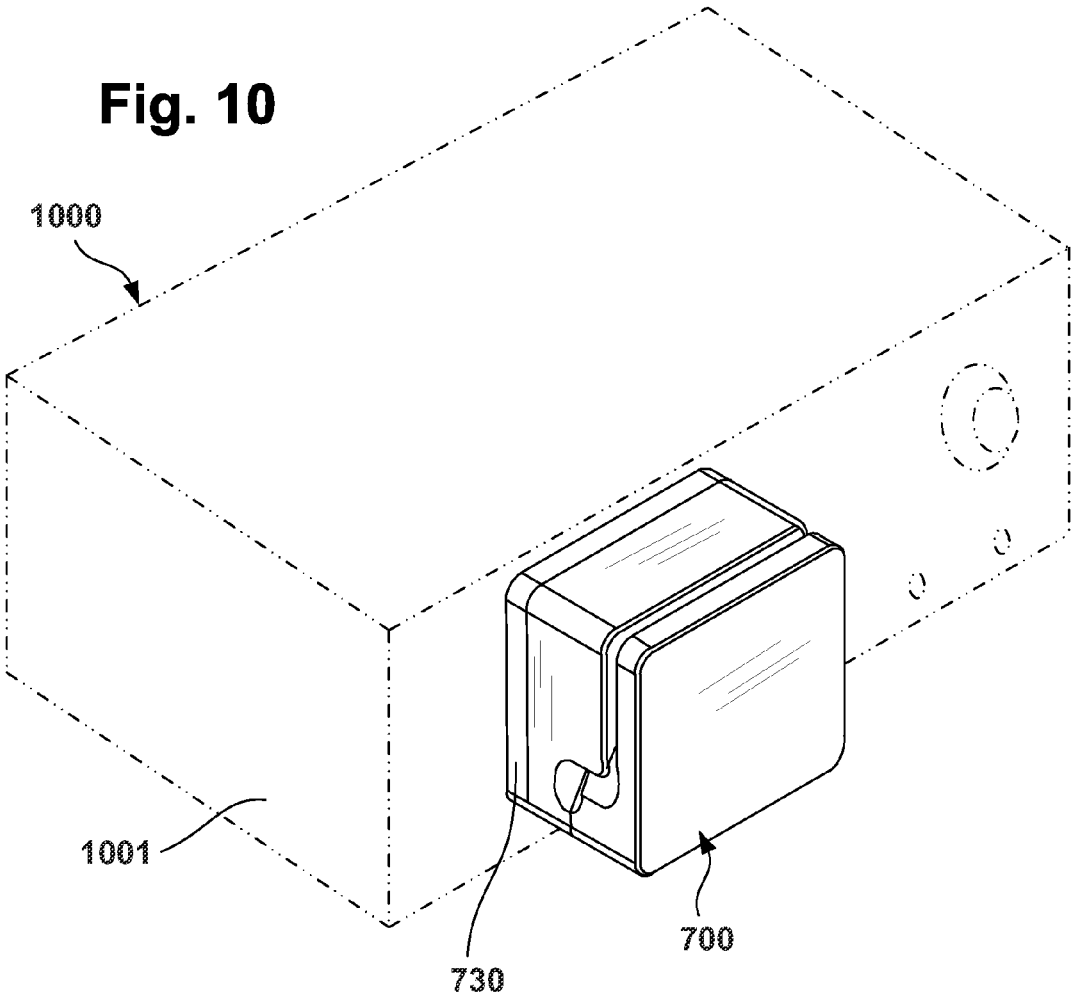
FIG. 10 is a perspective view of the roller assembly housing 700 attached to the pump motor housing 1000.

FIG. 10 shows the motor assembly housing 1000 with the roller assembly housing 700 attached to the pump motor housing 1001 by means of the attachment plate 730.

FIGS. 11A, 11B, and 11C show the prior art drawing of Parrott et al (U.S. Pat. No. 4,767,289) which disclose a peristaltic pump 20 to be used for extracorporeal circulation of blood and a complex peristaltic tubing 10 that utilizes two sets of four concentric tubes to construct a pressure-control valve 34 and a one-way-flow-valve 36 in order to prevent pumping blood in the wrong direction in case the tubing is inadvertently inserted within the pump in the wrong direction. In contrast, the second embodiment of the present invention (see FIG. 2A) is designed such that it is impossible to insert the tubing in the wrong direction.

The Parrott prior art patent reference discloses peristaltic pump tubing which is not a single piece of continuous tubing but must be a combination of an inlet tubing 26, which is connected to by means of an inlet barbed hose attachment 56 to the pump tubing 10, and an outlet barbed hose attachment 66 which connects pump tubing 10 to the outlet tubing 90. Peristaltic tube attachment members such as 56 and 66 add complexity and expense to the manufacturing process and have a tendency to leak under high pressure. In contrast, all the embodiments of the peristaltic tubing disclosed in the present invention are constructed by means of a continuous extrusion which eliminates tube connectors, simplifies tubing assembly and sterilization processes and eliminates the risk of fluid leaks between attachment members.

The Parrott prior art patent reference appears to disclose a method for securing the pump tube 10 within the peristaltic pump housing 20 which relies on a pair of tube clamps TC (not described by Parrott) and also relies on the difference in outer diameter between the larger diameter rigid tubing of the pressure valve housing 56 and the one-way-flow valve housing 62 relative to the smaller diameter flexible central portion of the pump tube 10. The step-off 60 between the larger diameter pressure valve housing tube 56 and smaller diameter central tube segment 30 helps to secure the pump tube 10 in place with respect to the pump housing 20 after a tube clamp TC has entrapped the smaller diameter central tube segment 30. Similarly the step-off 64 between the larger diameter pressure valve housing tube 62 and smaller diameter central tube segment 30 helps to secure the pump tube 10 in place with respect to the pump housing 20 after a tube clamp TC has entrapped the smaller diameter central tube segment 30. Parrott does not discuss the process and means by which pump tube 10 is placed within the tube clamps TC. Based on simple geometry and elementary topological considerations there must be a means of opening the clamps TC, inserting the tube 10 between two semicircular jaws SJ (not described by Parrott) of the clamp TC and then closing the clamp TC about the tube 10. The mechanism for opening and closing a clamp TC and preventing the clamp from inadvertently opening and unintentionally releasing of the pump tubing 10 is also not described by Parrott. In contrast one of the principal claims of the present invention is the novel method of inserting pump tubing into the roller assembly housing and securely fixing the pump tubing within the roller assembly housing (described in detail below) such that the roller pump housing has no moving parts.

FIGS. 12A and 12B show the prior art drawings of Montoya (U.S. Pat. No. 5,342,182), which disclose tubing 38 "provided with a variable cross-sectional width," which is designed to "minimize the total pump priming volume". Montoya's tubing has constant wall thickness and the variability of the tubing width. Such a tubing design does require ancillary connectors and attachment means 40, typically a clamp or other well known mechanism, to attach the pump tube 38 to the supply tube 53 and the outlet tube 55 and also requires an anchoring mechanisms 60 consisting of multiple parts to attach the tubing to the roller assembly housing and to orient tube 38 and to prevent tube migration.

The tubing with variable cross-sectional inside diameter and variable outside diameter as described by Montoya consisting of a filling region 118, constant width intermediate section 119 at the end of the filling region 118, smooth width transition segment 120 with decreasing width, a decreased or narrower constant width section 121, and finally an outlet region 122 of tube 38. The dilated or largest outside segment of the Montoya tubing 38 is intended to be compressed by the rollers 36 located inside the roller assembly housing (not shown). Montoya (U.S. Pat. No. 5,342,182 in column 7, lines 21-28) states, "Also, it is advantageous to maintain a relatively narrow cross-section at the beginning of the inlet region 118, where the incoming roller 36 just begins to trap the fluid in the filling region, thus allowing for a lower tension to occlude and hold the filling pressures. Otherwise, more fluid may slip past the rollers and not be pumped forward. For this reason, the filling region 118 is not made as wide as the widest part of the tubing 38." In contrast, in the present invention the segment of tubing with the largest outside diameter must always be located outside the roller assembly housing where it can never be compressed by the rollers and where its primary function is to act as a stopper which helps to align the tubing with the rollers and prevents the tubing from migrating through the pump. Thus, although the Montoya tube and the present invention have somewhat similar geometric shapes their respective functions are entirely different and unrelated.

The following describes a suitable pump arrangement for implementation of the above-described peristaltic pump system. The system may include a pumphead assembly that is a HK Surgical pumphead (interchangeable with a Watson-Marlow 313D in the sense that it uses the identical attachment plate and identical roller assembly). The roller tubing 110 may have a 1.6 mm or 2.4 mm wall thickness with 3 or 4 roller peristaltic-pump-head, such as Watcho-Marlow 313D or 314D pumpheads. The general overall dimensions may have a height of 3 to 5 inches, a width of 9 inches and a depth of 13 inches. The peristaltic pump system may have a variety of mounting options, such as table-top mount with non-skid foot-pads, or IV pole mountable. The peristaltic pump system may be configured to be operated in any position (upright, on its side, upside down). It is contemplated that the housing being relatively easy to open and closed to access pump components for repairs and inspection. The pump may be powered by varies means such as AC current and/or efficient rechargeable batteries. The pump motor may be a stop motor and may be two directional. A control interface may control the pump directionality. In this regard, the control interface may include analog (such as turn-knob dials) and/or digital (such as an LCD touch screen.). Suitable pump flow rates may be from 0 ml/min up to 800 ml-1000 ml per minute. Audible indicator tones may be used to indicate pump-rate and pulse duration. In a continuous mode a rate of beeping tone may correlate with a rate of rotation of the peristaltic rollers. In a pulse mode a continuous audible tone is used when the pump motor is actuated and pumping. The continuous audible tone has a variable tone wherein the pitch of frequency (Hz) of the tone varies in direct proportion to the rotation rate of the pump rollers. Volume controls may be provided for all audible indicators. Various safety features may be provided. A safety cut-off switch may be provided that is actuated when the housing is open. A warning may be provided for low batteries levels. A warning may be provided when fluid flow has stopped, for example when an IV bag is empty.

The pump may have a variety of pump controls. An "insert-tubing" button may control the roller to rotate continuously at a slow rate during insertion of the tubing into the pumphead assembly. A "remove-tubing" button may control the roller in an opposite direction. A "pump-prime" button may be held down to prime the pump tubing (fill the tubing with fluid and purge the tubing of air bubbles) following insertion of the tubing. Two pneumatic connection ports may be provided for air-bellow actuator switches to accommodate remote foot pedal switches preferably located on a surface that is easily accessed (near front control panel). An additional pneumatic connection port may be provided for an extra-sensitive pneumatic air-bellows switch actuator. The pump actuator may have several modes of operation. There may be a "persistent pressure" mode where the pump operates for as long as the bellow is compressed. There may be a "radio button" mode where the pump starts with an initial compression and stops with second compression. There may be a "trigger" mode where an initial compression starts the pump for a predetermined limited duration (the duration may be user selected). There may be a "gas peddle" mode where the rate of roller rotation depends on the degree of pressure applied to a bellows-switch. The pump motor may have a various flow modes. There may be a "continuous flow" mode where fluid flow is continuous. There may be a "pulsatile flow" mode where fluid flow is pulsatile. This may include on/off switch, a control to set pumping duration of continuous pumping action, and a control to specify the pause duration between sequential pulses.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above.

The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A peristaltic pump system comprising:

elastomeric pump tubing having a pumping segment and an inlet segment, the inlet segment having an inlet segment outer diameter, the pumping segment having a pumping segment outer diameter less than the inlet segment outer diameter; and a roller pump having a roller assembly and a roller assembly housing, the roller assembly being disposed within the roller assembly housing and engaged with the pumping segment within the roller assembly housing, the roller assembly housing defining an inlet gap therein, the inlet gap having an inlet gap inner diameter smaller than the pumping segment outer diameter, the roller assembly housing being adapted to frictionally engage the inlet segment adjacent the inlet gap for aligning the pump tubing with a roller assembly and mitigate longitudinal movement of the pump tubing into the roller assembly housing.

2. The peristaltic pump system of claim 1 wherein the pump tubing has a constant wall thickness along a length of the pumping segment.

3. The peristaltic pump system of claim 1 wherein the pumping segment has a varying wall thickness along a length of the pumping segment.

4. The peristaltic pump system of claim 1 wherein the inlet segment outer diameter is constant along a length of the inlet segment.

5. The peristaltic pump system of claim 1 wherein the pumping segment outer diameter varies along a length of the pumping segment.

6. The peristaltic pump system of claim 1 wherein the pump tubing further has an outlet segment with the pumping segment disposed between the inlet segment and the outlet segment, the outlet segment is engaged with the pumping segment.

7. The peristaltic pump system of claim 6 wherein the outlet segment has an outlet segment outer diameter that is constant along a length of the outlet segment.

8. The peristaltic pump system of claim 6 wherein the outlet segment has an outlet segment outer diameter that is the same as the pumping segment outer diameter.

9. The peristaltic pump system of claim 6 wherein the inlet segment has a wide portion and a narrow portion with the wide portion disposed between the narrow portion and the pumping segment, the inlet segment outer diameter is disposed at the wide portion.

10. The peristaltic pump system of claim 6 wherein the outer diameter of the narrow portion is the same as the outer diameter of the outlet segment.

11. The peristaltic pump system of claim 9 wherein a wall thickness of the wide portion is greater than a wall thickness of the pumping section.

12. The peristaltic pump system of claim 1 wherein the inlet segment includes a stopper ring disposed circumferentially about the tubing, the stopper ring defines the inlet segment outer diameter.

13. The peristaltic pump system of claim 1 wherein the inlet segment includes a semi-tubular segment disposed circumferentially about the tubing, the semi-tubular segment defines the inlet segment outer diameter.

14. The peristaltic pump system of claim 1 wherein the pumping segment and the inlet segment are formed of a single continuous piece of material.

15. The peristaltic pump system of claim 1, wherein the pumping segment defines a generally continuous circular cross section.

16. A peristaltic pump system comprising:

elastomeric pump tubing having a pumping segment and an inlet segment, the inlet segment having a stopper ring disposed circumferentially about the tubing to define an inlet segment outer diameter, the stopper ring being torus-shaped, the pumping segment having a pumping segment outer diameter less than the inlet segment outer diameter; and a roller pump having a roller assembly and a roller assembly housing, the roller assembly being disposed within the roller assembly housing and engaged with the pumping segment within the roller assembly housing, the roller assembly housing having an inlet gap formed through the roller assembly housing, the inlet gap defining an inlet gap inner diameter smaller than the pumping segment outer diameter, the inlet gap being adapted to frictionally receive the inlet segment for aligning the pump tubing with a roller assembly and mitigate longitudinal movement of the pump tubing into the roller assembly housing.

* * * * *